United States Patent [19]

Newton

[11] 4,000,964

[45] Jan. 4, 1977

[54] POLYCHROMATOGRAPHIC DYEING

[75] Inventor: Clifford Newton, Stockport, England

[73] Assignee: BSG Designs Inc., London, England

[22] Filed: Dec. 10, 1974

[21] Appl. No.: 531,390

[30] Foreign Application Priority Data

| | | |
|---|---|---|
| Dec. 15, 1973 | United Kingdom | 58237/73 |
| May 24, 1974 | United Kingdom | 23245/74 |
| Aug. 14, 1974 | United Kingdom | 35683/74 |

[52] U.S. Cl. ..... 8/14; 8/34; 8/54.2; 8/62; 8/149; 68/200

[51] Int. Cl.[2] ..... D06P 3/00

[58] Field of Search ..... 8/14, 34, 62, 1 R, 149

[56] References Cited

UNITED STATES PATENTS

| | | | |
|---|---|---|---|
| 128,302 | 6/1872 | Guichard | 8/62 |
| 763,196 | 6/1904 | Miegel | 8/14 |
| 790,718 | 5/1905 | Bucher | 8/14 |
| 1,202,652 | 10/1916 | Bentley | 8/14 |
| 1,607,821 | 11/1926 | Garey | 8/149 |
| 2,202,283 | 5/1940 | Cassel | 8/62 |
| 2,271,999 | 2/1942 | Gariepy | 68/203 |
| 2,573,097 | 10/1951 | Epstein | 68/203 |
| 2,648,088 | 8/1953 | Bailey | 68/200 |
| 3,311,519 | 3/1967 | Touey et al. | 68/203 |
| 3,490,860 | 1/1970 | Soiron et al. | 8/62 |
| 3,861,869 | 1/1975 | Schwindt et al. | 8/62 |
| 3,909,191 | 9/1975 | McCoy | 8/62 |

OTHER PUBLICATIONS

J.S.D.C., 81 (Jan. 1965) article by Fox at pp. 7–10.

*Primary Examiner*—Ronald W. Griffin
*Attorney, Agent, or Firm*—Larson, Taylor and Hinds

[57] ABSTRACT

Coloration of a dyeable substrate is effected by using an eluant to modify the appearance of unfixed dyestuff in the substrate.

4 Claims, 1 Drawing Figure

POLYCHROMATOGRAPHIC DYEING

Figure 1:
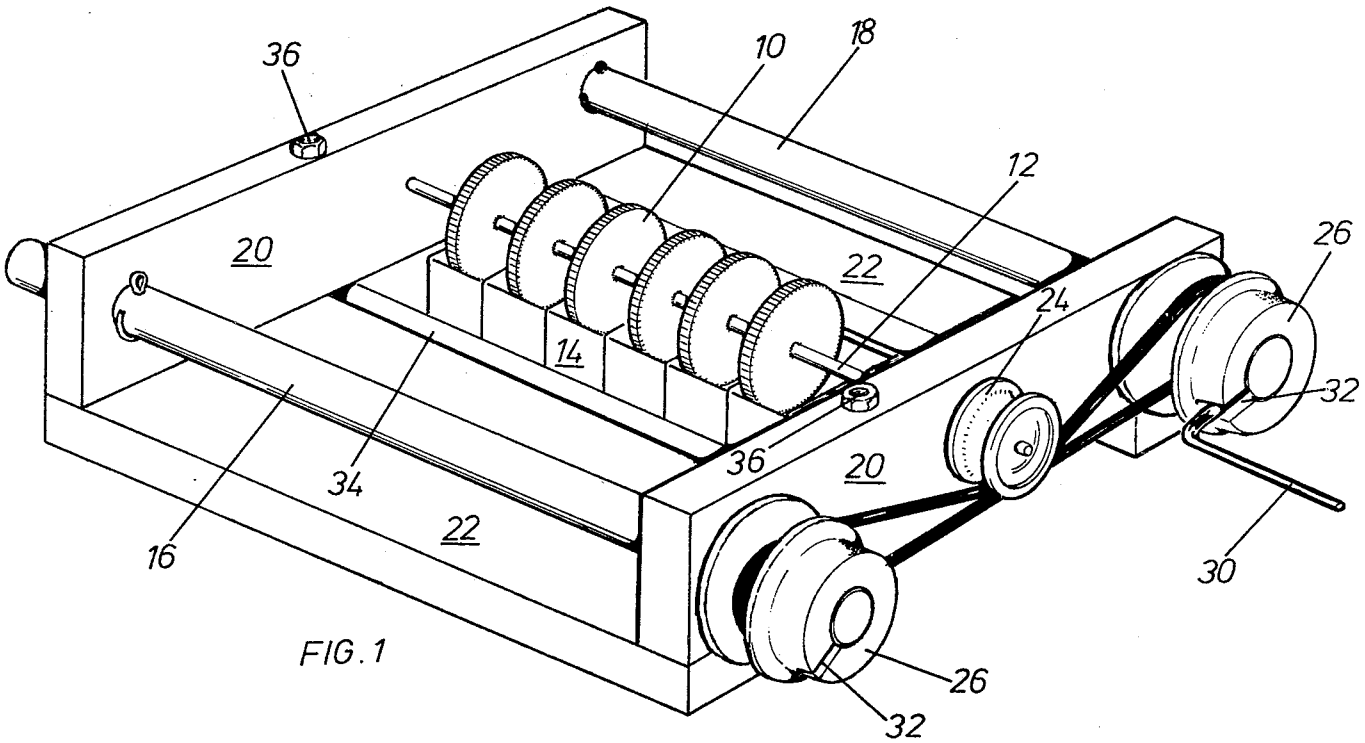

The invention relates to the colouration of materials by the application of dyestuffs.

Suitable materials for colouration, that is dyeable substrates include textile webs or sheets, paper, leather, card, wood and any other porous or non-porous material which is dyeable. Suitable dyestuffs include reactive, direct azoic and any other kind of dyestuff which is adaptable to the apparatus and suitable for the substrate. The actual technique employed depends on the particular dye and substrate and the ancillary equipment available, for example for drying, baking, steaming, or wet processing.

The invention provides a method of effecting colouration of a dyeable substrate wherein an eluant is used to modify the appearance of unfixed dyestuff in the substrate. Dyestuff is applied, before fixation eluant is applied to modify the appearance of the dyestuff, and the dyestuff is then fixed or allowed to fix.

The term 'eluant' is taken from chromatography wherein it is used to denote a solvent for washing out material deposited on an absorbent material such as paper, silica gel, or clay. As used herein, the term does not have this exact meaning but the function of the liquids described herein as "eluants" is analogous to that of eluants used in chromatography and is basically a displacement function.

When a substrate has a dye liquor applied thereto, there is no immediate reaction with the fibres. Reaction usually has to be induced, for example by allowing the substrate to stand for some time (cold fixation) or by the application of wet or dry heat (hot fixation). Immediately after application, the dye liquor merely fills (or substantially fills) the interstices in the substrate. When an eluant is applied to the substrate at this stage, for example at a point or on a line, the eluant displaces the dye liquor in the substrate away from the position of its application, and it spreads throughout the substrate by capillary action. The rate and extent of the spreading is determined by the quantity of the eluant applied, its viscosity and other properties. Little or no mixing of the eluant with the dye liquor occurs.

If the eluant is colorless and applied at a point, for example as a drop, then it will spread to form a generally circular patch containing little or no dye liquor. If the substrate is white, the patch will show as an irregular white, or very pale colored, spot. The eluant may contain or consist of a dye liquor, in which case the path can be of a color different from that of the first-applied dye liquor.

The dyestuff initially applied may comprise a mixture of two dye liquors of different colors and having different fixation properties. This forms an area of color. One dye may then be caused or allowed to undergo fixation without fixation of the other. An eluant is then applied to displace the unfixed dye liquor wholly or partly out of the area. Consequently the area attains or nearly attains the color of the first dye and the area of substrate around and adjacent the first-mentioned area attains or nearly attains the color of the second dye. The second dye may then be caused or allowed to undergo fixation.

If the first-mentioned area is a spot or generally circular area, the final result is a pattern having a central generally circular area of the colour of the first dye merging at its periphery with a surrounding band of the color of the second dye. The periphery and the band are irregular due to irregular movement of the dye liquors in the substrate. In a woven fabric, for example, there is often more spreading along the warp and weft than inclined to those directions.

In a method according to the invention, a substrate has been laid on a glass plate, and a second glass plate having an array of apertures therein has been placed on top of the fabric. Dye liquors and eluants have been applied to the material through the apertures at appropriate times. The sandwiching between the plates prevents excessive evaporation of the liquids. In another method, a sheet of material has been folded into a package of small size. One or more corners of the package have been dipped into a bath or baths of dye liquor and of eluant at appropriate times to form an array of similar patterns on the sheet. If the sheet is rectangular, a pattern symmetrical about the folds is formed.

Alternatively, the eluant can be applied along lines, for example continuous strips, so as to effect a striped patterning of the fabric. If a pattern is required which has three or more colours, then the above processes can be repeated to obtain the desired effects.

For polychromatic dyeing, dye liquors and eluant are caused to flow onto the fabric as it is moved through a polychromatic dyeing machine. For vat dyestuffs, a typical sequence of operations might be as folows:

1. Pad with vat pigment;
2. Apply the eluant;
3. Dwell;
4. Chemical pad in steam;
5. Oxidize, wash and dry.

With direct dyes, the following might be a typical sequence of operations:

1. Pad with the direct dye;
2. Apply the eluant;
3. Dwell or sky;
4. Fix.

Any desired sequence of dye and eluant applications can be followed to obtain a wide range of effects.

The invention includes apparatus for the coloration of a dyeable substrate comprising a number of rotatable discs, at least one container for dye liquor into which a lower portion of the discs dip, and means for passing the substrate in contact with an upper portion of the discs and rotating the discs so that dye liquor is applied to the substrate.

The thickness of the discs and their arrangement with respect to each other and to the container or containers for dye liquor into which they dip may be varied according to the dye pattern desired. For example the discs may be mounted on one or more shafts and rotatable with the shafts or with respect to the shafts in the same sense or in the opposite sense to the material for dyeing. By intermittent contacting of discs with substrate, a broken or dotted pattern can be obtained. A single dye liquor or a number of different dye liquors in different containers may be applied in one or more applications separated by partial or total fixing and/or elution of the dyestuffs. The thickness, diameter, number and spacing of the discs can be varied to vary the pattern produced.

After dye application, the web can be passed through a nip, and the eluant applied soon afterwards. When dyeing heavy fabrics, for example curtains or blankets, two sets of discs can be provided with the pairs of discs providing nips through which a web can be passed vertically, dye liquor, from containers beneath the discs, being applied to both sides of the web.

Alternatively the dye liquor may be applied by means of jets.

Apparatus according to the invention is illustrated by way of example in the drawing in which:

FIG. 1 is a perspective view of a first embodiment.

The apparatus is shown in perspective and comprises a number of rotatable discs 10 having milled edges. The discs 10 are all fast on a shaft 12. Lower parts of the discs 10 dip each into an individual container 14 for dye liquor. Means for passing a sheet of dyeable substrate in contact with upper parts of the discs 10 for the application of dye liquor comprises a take-off roll 16, a take-up roll 18 and means for rotating the rolls 16 and 18.

The shaft 12 and the rolls 16 and 18 all extend through frame members 20 which are mounted fast on base members 22. The shaft 12 has fast thereon outside the frame member 20 a pulley 24. The rolls 16 and 18 each have rotatably mounted thereon outside the frame 20 a pulley 26. A belt 28 extends around the pulley 26 and under the pulley 24 so that the shaft 12 and discs 10 can be rotated in the sense opposite to the rolls 16 and 18. A handle 30 is fast on a shaft which fits closely inside the roll 18 and so cannot be seen in the drawing, and in a slot 32 in the pulley 26 so that rotation of the handle 30 turns the roll 18. By removing the handle 30 from the roll 18 and inserting it in the roll 16, the functions of the rolls 16 and 18 may be reversed, or the substrate may be wound from one roll to the other.

The containers 14 are fast on a bar 34 which has upright bolts 36 whereby it can be secured to the frame members 20.

In operation, dye liquor is placed in each container 14, the substrate is wound onto the take-off roll 16, stretched across the upper edges of the discs 10 to the take-up roll 18, and by turning the handle 30 the substrate is passed in contact with the discs 10 rotating in the opposite direction to the passage of the substrate so that dye liquor is applied thereto. By intermittent breaking of the contact between the substrate and the discs, broken strips or dots of dye liquor can be applied to the substrate. The dyestuff or a component thereof can then be fixed, and the substrate then again passed through the apparatus with eluant for another component of the dyestuff in the containers. The other component can then be fixed and the substrate washed and finished.

The invention is illustrated by the following Examples in which PROCION, MANUTEX, CALGON and MATEXIL are Trade Marks used to indicate the materials in connection with which they have a reputation.

EXAMPLE 1

Stock dye liquor solutions were made up as follows:-

Solution A — Brown 5 grams PROCION Brown MXGR and 20 grams urea, were made up to 50 cc with cold water.

Solution B — Black 5 grams PROCION Black HN and 20 grams urea, were made up to 50 cc with cold water.

Solution C — (Thickening agent)

25 grams of MANUTEX /RS (sodium alginate) and 6.25 grams of sodium hexametaphosphate were made up to 1 liter with water.

PROCION M-type dyes are highly reactive and fix cold.

PROCION H-type dyes are less reactive so their fixation can only be effected by heat.

A working solution was made up as follows:

7.5 cc of Solution A
5.0 cc of Solution B
1.0 of Solution C
0.5 grams sode ash made up to 20 cc with water.

An eluant solution was made up as follows: 1.0 cc of Solution C
0.5 grams of soda ash made up to 20 cc with water.

A sheet of white cotton cloth was sandwiched between two plates of glass, the upper plate having 16 apertures each one quarter of an inch in diameter spaced at 4 inch intervals in a rectangular array. Into each aperture was placed approximately 0.5 cc of the working solution. The cloth was left to stand for 1 hour. During this time the solution spread to form a generally circular area of brown/black colour between two and three inches across. Further, the brown dye being a PROCION M-type dye underwent fixation, i.e., chemical union with the fibres of the cloth. After 1 hour there was applied to each aperture about 0.5 cc of the colorless eluant solution. The eluant spread out from each point of application driving or eluting the black dye (as yet unfixed and merely physically held by the cloth) outwardly to form a corona around the originally coloured area. As the black dye was driven out the original area exhibited a brown coloration due to the fixed dye. The black dye eventually formed a ring around the original area, merging therewith at the adjacent edges and having an irregular outer periphery. After elution, the cloth was colored with an array of patterns each comprising a brown area surrounded by a black corona or ring.

EXAMPLE 2

As a variation on Example 1, a PROCION H-type dye was applied alone and allowed to spread to form a generally circular area. After spreading a colorless eluant was applied. This caused outward migration of the dye. A pattern was obtained comprising a ring around the white (or very pale coloured) area. Fixation was effected by heating.

EXAMPLE 3

As a second variation on Example 1, a PROCION H dye alone was applied and fixed by heating. After fixation, a PROCION H dye of a different color was applied and allowed to spread. A colorless eluant was then applied to form a ring of the second color dye in or around the first area.

EXAMPLE 4

As a further variation, a piece of fabric was completely wetted with a PROCION H-type dye and, before fixation, a dye-containing eluant was applied to form areas of another color. Fixation was effected by heat.

EXAMPLE 5

The following dye liquor was prepared:

| | |
|---|---|
| Stock thickening | 1.25 g |
| Urea | 4.5 g |
| PROCION Yellow H.4G | 1.0 g |
| PROCION Olive MX.3G | 1.0 g |

-continued

| | |
|---|---|
| Bulked with water to | 25.0 ml |
| Stocking thickening is | |
| MANUTEX RS | 25 parts |
| CALGON PT | 6 " |
| MATEXIL WA.KB | 19 " |
| Bulked with water to | 1000 " |

10 ml of the dye liquor was introduced into the left hand tank 14 of the apparatus illustrated in FIG. 1 of the drawings. 10 ml of the remaining dye liquor was reduced to half strength by the addition of 10 ml of a liquor containing:

| | |
|---|---|
| Stock thickening | 50 parts |
| Urea | 100 parts |
| Bulked with water to | 1000 " |

10 ml of the reduced dye liquor was charged into the adjacent tank next to the left. The remaining dye liquor was further reduced in the same way four times and the increasingly reduced dye liquor which resulted was placed in each of the remaining containers in sequence. Additions of soda ash were made to each bath, in sequence, from left to right, as follows 0.3g, 0.3 g, 0.2 g, 0.1 g, 0.05g, 0.05 g.

A piece of woven cotton fabric 1.9 m × 18 cm and weighing 29.8 g, washed, dried and relaxed, was wound onto the take-off rolls 16, passed over the upper parts of the discs 10, and fastened to the take-up roller 18. The handle 30 was rotated so that the fabric was drawn over the discs 10 and dye liquor applied thereto in stripes. As soon as the fabric had been fully wound onto the roll 18, the handle 30 was withdrawn, inserted in the roll 16, and the fabric rewound onto the roll 16 passing again in contact with the discs 10 so as to have a second application of the dye liquor along the same stripes as in the first application.

The substrate was then allowed to stand for 20 minutes to allow cold fixation of the PROCION M dye. During this period, the containers 14 were emptied, and their contents replaced by eluant comprising

| | |
|---|---|
| Soda ash | 30 parts |
| Stock thickening | 50 parts |
| Urea | 100 " |
| Bulked with water to | 1000 " |

The fabric was then again passed twice over the discs 10 in exactly the same way as before with the discs following the stripes where the dye liquor had been applied in the first treatment. Again the substrate was allowed to stand for 20 minutes. Then it was unwound from the roll 16 and allowed to dry for a few minutes in the atmosphere. The PROCION H dye was then hot-fixed by placing the substrate in an oven at 200° F for 20 minutes. The substrate was then rinsed to remove excess dyestuff and boiled in soapy water to complete the operation.

A fabric striped in different intensities owing to the different concentrations with olive lines bordered by and merging into yellow lines was thus obtained.

I claim:

1. A method of effecting coloration of a dyeable substrate having interstices which comprises filling the interstics in the substrate with a mixture of dye liquors of different colors and different fixation properties, fixing at least one of said dye liquors, applying to said substrate an eluant for another of said dye liquors to promote migration thereof, fixing said migrated dye liquor and washing and finishing said substrate.

2. A method according to claim 1 wherein the dye liquor is applied by contacting with an upper portion of a number of rotatable discs, the lower portions of said discs dipping into containers of the dye liquor.

3. A method according to claim 1 wherein the eluant is applied by contacting with an upper portion of a number of rotatable discs, the lower portions of said discs dipping into containers of the eluant.

4. A method according to claim 1 wherein the dye liquor and eluant is applied by means of capillary tubes which pick up dye liquor and eluant.

* * * * *